United States Patent [19]

Ishii

[11] Patent Number: 4,540,913

[45] Date of Patent: Sep. 10, 1985

[54] CATHODE-RAY TUBE FOR COLOR DISPLAY WITH SEPARATE FLUORESCENT LAYER

[75] Inventor: Takashi Ishii, Nagaokakyo, Japan

[73] Assignee: Mitsubishi Denki Kabushiki Kaisha, Tokyo, Japan

[21] Appl. No.: 476,336

[22] Filed: Mar. 17, 1983

[30] Foreign Application Priority Data

Apr. 8, 1982 [JP] Japan ..... 57-60073

[51] Int. Cl.[3] ..... H01J 29/26

[52] U.S. Cl. ..... 313/466; 313/472; 313/473; 313/474

[58] Field of Search ..... 313/466, 472, 473, 474; 340/703, 708

[56] References Cited

U.S. PATENT DOCUMENTS

| | | | |
|---|---|---|---|
| 2,440,301 | 4/1948 | Sharpe | 313/473 X |
| 3,891,890 | 6/1975 | Yasuda et al. | 340/703 X |
| 3,892,995 | 7/1975 | Yamazaki | 313/472 X |
| 4,424,467 | 1/1984 | Masuda et al. | 313/473 X |

OTHER PUBLICATIONS

Japanese Gazette No. 86268/1975, Laid Open on Jul. 11, 1975, Entitled, "Cathode-Ray Tube for Display Terminal Unit".

*Primary Examiner*—Palmer Demeo

*Attorney, Agent, or Firm*—Lowe King Price & Becker

[57] ABSTRACT

A cathode-ray tube for color display comprises a face plate (1), a picture element layer (10) formed on an inner surface of the face plate and including two or more kinds of picture elements (5, 6 and 7), and a fluorescent material layer (4) formed between the picture element layer and the inner surface of the face plate and having a 10 percent afterglow time less than 50 microseconds. As necessary, a photoabsorptive material layer (2) may be provided in a matrix manner between the fluorescent material layer and the face plate. The picture element layer (10) performs a color display function and the fluorescent material layer (4) performs a communication function by means of a light pen. In case that a communication function by means of a light pen is not required, the step of forming the fluorescent material layer (4) may be omitted. Therefore, in manufacturing a cathode-ray tube requiring a communication function by means of a light pen and a cathode-ray tube not requiring such function, the same production line can be effectively utilized.

7 Claims, 1 Drawing Figure

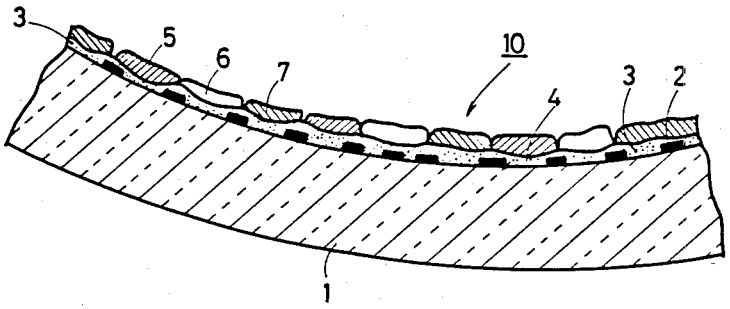
3
5
6
7
10
4
3
2
1

CATHODE-RAY TUBE FOR COLOR DISPLAY WITH SEPARATE FLUORESCENT LAYER

BACKGROUND OF THE INVENTION

1. Field of the Invention

The present invention relates to a cathode-ray tube for color display used in a color display device which is a terminal unit of a computer, said cathode-ray tube being capable of applying an input to the computer by the operation of a light pen.

2. Description of the Prior Art

A display device for entering information by using a light pen from a cathode-ray tube to a display control device including a computer is known in the art. The cathode-ray tube in such a conventional display device is used for monochromatic display. It comprises a luminescent screen coated with a mixture of a fluorescent material having a predetermined luminescent color and a short afterglow fluorescent material having a ten percent afterglow time less than 50 microseconds, so that communication with the display device can be established by the operation of a light pen. Recently, color display devices have been often used, and there has been a demand that color display devices have also such a communication function with a light pen as in monochromatic display devices.

A luminescent screen of a cathode-ray tube for color display used in a color display device includes generally three picture elements, which differs from the case of a cathode-ray tube for monochromatic display. A picture element layer comprising these three picture elements is formed by a photographic printing method or the like and accordingly a far greater amount of fluorescent materials is required as compared with the case of a cathode-ray tube for monochromatic display in order that a light pen can be used. In addition, aside from the amount of fluorescent materials, it is not easy at the time of manufacturing cathode-ray tubes for color display to apply a coating discriminately for those not requiring light pen operation or those requiring such. More specifically, if a fluorescent material for each picture element is mixed with a fluorescent material having a ten percent afterglow time less than 50 microseconds to make a photosensitive slurry for coating by a photographic printing method for the purpose of improving an operational function of a light pen, such a slurry cannot be used for forming a luminescent screen which does not require light pen operation. The reason is that even if the same fluorescent material is used, the color of an ultrashort fluorscent material, that is, a fluorescent material having a 10 percent afterglow time less than 50 microseconds differs from the original color and its brilliance is decreased and as a result the luminescent color and brightness are deteriorated. Specifically speaking, as an ultrashort afterglow fluorescent material, P16, P31, P24, P36, P38, P48, P46, P47 or the like are conventionally used. For example, if P46 ($Y_3Al_5O_{12}$:Ce) is used to form a luminescent screen by mixing each luminescent picture element of the three primary colors red, blue and green with five percent weight of P46 for coating, the luminescent brightness of each luminescent picture element is decreased by approximately 10% and the luminescent color of each picture element is perceptibly changed with a bluish color caused by the P46. Accordingly, in order to manufacture a luminescent screen of an unchanged color which does not require light pen operation, it is necessary to prepare a photosensitive slurry not including P46 for each color, which causes a complication of a manufacturing process and decreases considerably the manufacturing efficiency.

SUMMARY OF THE INVENTION

In summary, the present invention comprises a cathode-ray tube for color display, comprising: a face plate, a picture element layer formed on the inner surface of the face plate and including two or more kinds of luminescent picture elements, and a fluorescent material layer formed on the inner surface of the face plate together with the picture element layer and having a 10 percent afterglow time less than 50 microseconds.

According to the present invention, since a ultrashort afterglow fluorescent material layer having a 10 percent afterglow time less than 50 microseconds is provided, a communication function by means of a light pen is provided. Furthermore, since the picture element layer and the ultrashort afterglow fluorescent material layer are separately coated on the face plate, there is no reduction of the brightness of the luminescent picture elements and there is little change in the luminescent color. Accordingly, in case that no light pen is utilized, color display can be made of information in the same manner as that of an ordinary color cathode-ray tube.

Accordingly, a principal object of the present invention is to provide a cathode-ray tube for color display which makes it easy to discriminately coat a fluorescent material to provide a communication function by means of a light pen or not to provide such function and, in which there is no reduction of brightness of the luminescent picture elements and there is little change in luminescent colors even in case where a communication function is provided.

According to the present invention, the fluorescent material for picture element and the ultrashort afterglow fluorescent material are not mixed for preparing a photosensitive slurry. The picture element layer and the fluorescent material layer are separately formed by each coating process. As a result, for manufacturing a cathode-ray tube for color display requiring light pen operation, a slurry of an ultrashort afterglow fluorescent material is used and for manufacturing an ordinary cathode-ray tube for color display not requiring light pen operation, the above mentioned slurry is not needed. Therefore, an advantage of the present invention is that the same production line is efficiently used for manufacturing different cathode-ray tube for color display.

Another advantage of the present invention is that the slurries for forming the picture elements of the three primary colors' luminescent fluorescent materials (red, blue and green) conventionally used for manufacturing cathode-ray tubes for color display can be used for manufacturing the cathode-ray tubes for color display having a communication function by a light pen as well as for manufacturing the ordinary cathode-ray tubes for color display without the communication function. In consequence, it is not necessary to prepare twice a photosensitive slurry and the time for it can be saved.

A further advantage of the present invention is that the amount of the ultrashort afterglow fluorescent materials can be reduced to a half of that in a conventional type and thus the manufacturing cost can be remarkably reduced.

Still a further advantage of the present invention is that since the picture element layer and the ultrashort afterglow fluorescent material layer are discriminately coated on the face plate there is no reduction of the brightness of the luminescent picture element and there is little change in the luminescent colors. Accordingly, even in the case where no light pen is utilized color display can be made of information in the same manner as that in an ordinary cathode-ray tube for color display.

These objects and other objects, features, aspects and advantages of the present invention will become more apparent from the following detailed description of the present invention when taken in conjunction with the accompanying drawing.

BRIEF DESCRIPTION OF THE DRAWING

The attached drawing shows a partial section view of a luminescent screen of a cathode-ray tube for color display in accordance with the present invention.

DESCRIPTION OF THE PREFERRED EMBODIMENT

The attached drawing shows a sectional view of one portion of a luminescent screen of a cathode-ray tube for color display in accordance with the present invention. In accordance with the present invention, the character 1 indicates a face plate, the character 2 indicates a photoabsorptive material layer, the character 3 indicates granules of an ultrashort afterglow fluorescent material, the character 4 indicates an ultrashort afterglow fluorescent material layer composed of said granules 3 and the characters 5, 6 and 7 indicate respectively green, blue and red picture elements which constitute a picture element layer 10.

The picture element layer 10 is a composite layer formed in a repetitive manner by a known photographic printing method comprising the steps of coating, drying, photographic printing and developing for each picture element forming slurry which forms the luminescent picture element 5, 6 or 7. The picture element layer 10 and the photoabsorptive material layer 2 in the form of a matrix directly formed on the inner surface of the face plate 1 are well known in the art and a detailed description of the same is not given in the present specification. In the embodiment illustrated in the FIGURE, the fluorescent material layer 4 is formed between the picture element layer 10 and the photoabsorptive material layer 2. The fluorescent material layer 4 is formed, after the photoabsorptive material layer 2 is formed on the inner surface of the face plate 1, in a manner wherein a photosensitive slurry composed of a photoresist material and granules 3 of a known ultrashort afterglow fluorescent material having a ten percent afterglow time less than 50 microseconds is applied by a known rotary coating method and then dried and totally exposed to the light. For the granules 3 of a known ultrashort afterglow fluorescent material, any fluorescent material can be used besides the above mentioned P16, P24, P31, P36, P38, P46, P47 and P48, as far as it is adapted to the response characteristic of a light pen to be used and has a 10 percent afterglow time less than 50 microseconds. In addition, the fluorescent material layer 4 may not be necessarily positioned between the photoabsorptive material layer 2 and the picture element layer 10 as described above. It may be positioned on the side opposite to the photoabsorptive material layer 2 with reference to the picture element layer 10, that is, on the surface of the picture element layer 10 on the side of an electron gun. However, it is preferred that the fluorescent material layer 4 is provided between the picture element layer 10 and the inner surface of the face plate 1. The reason is that although the fluorescent material lying in the layer closer to the electronic gun is more luminous, it is preferred that the picture element layer 10 is more luminous for display while the fluorescent material layer 4 for a light pen need not be more luminous. For forming the fluorescent material layer 4, granules may be made of one fluorescent material or a plurality of fluorescent materials.

Now, one example of the present invention will be described in the following.

EXAMPLE

After a graphite layer of photoabsorptive matrix is formed on the inner surface of a face plate of a cathode-ray tube of 20 inches by a well-known method, an ultrashort afterglow fluorescent material slurry obtained by mixing 50 g of the fluorescent material P47 ($Y_2SiO_5$:Ce), 5 g of ten percent polyvinyl alcohol, 5 cc of ammonium dichromate solution and 440 cc of distillated water is applied on the graphite layer and dried. After the slurry is dried, the whole inner surface of the face panel is exposed to the ultraviolet rays for hardening so that an ultrashort afterglow fluorescent material layer having a ten percent afterglow time of 80 nanoseconds is formed. After that, using fluorescent materials ZnS:Cu:Al, ZnS:Ag and $Y_2O_2S$:Eu respectively for luminescent picture elements green, blue and red, a composite picture element layer is formed by a known photographic printing method. The slurries used for forming the luminescent picture elements of the three primary colors are the conventional ones.

Since a color cathode-ray tube thus manufactured comprises an ultrashort afterglow fluorescent material layer 4 of a proper thickness, the same has a communication function by means of a light pen. In addition, since the picture element fluorescent material and the ultrashort afterglow fluorescent material have not been mixed up, there is little change in luminescent color of each of the luminescent picture elements. Since a packing state of each of the luminescent picture elements becomes better when the picture element layer 10 is coated on the fluorescent material layer 4, a decrease of the luminescent brightness of each of the luminescent picture elements is avoided. More specifically, although the picture element 10 is usually coated with slurry, a flow of the slurry becomes poor when there is the fluorescent material layer 4 on the face plate 1 and the packing state of each of the luminescent picture elements after spin coating becomes better whereby the luminescent brightness of each of the luminescent picture elements is increased. On the other hand, since there exists the fluorescent material layer 4 between the picture element layer 10 and the face plate 1, the brightness of the respective luminescent picture elements is slightly decreased. As a result of the foregoing, reduction of the luminescent brightness of each of the luminescent picture elements is eliminated in total. Therefore, the inventive cathode-ray tube for color display can make color display of information in the same manner as that of an ordinary cathode-ray tube for color display, in a case wherein a light pen is not utilized.

Meanwhile, if and when a communication function by means of a light pen is not required, the step of forming the fluorescent material layer 4 is omitted and the fluorescent material layer 4 is formed on the face plate 1.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cathode-ray tube for color display, comprising:

a face plate (1), said face plate having an inner surface, a picture element layer (10) formed on the inner surface of said face plate and including a plurality of kinds of luminescent picture elements (5, 6 and 7), and a separate flourescent material layer (4) separately formed on the inner surface of said face plate together with said picture element layer, said separate layer having a 10 percent afterglow time less than 50 microseconds.

2. A cathode-ray tube for color display in accordance with claim 1, wherein said separate fluorescent material layer (4) is formed between said picture element layer (10) and the inner surface of said face plate (1).

3. A cathode-ray tube for color display in accordance with claim 1, which further comprises a photoabsorptive material layer (2) formed in a matrix manner and located between said separate fluorescent material layer (4) and the inner surface of said face plate (1).

4. A cathode-ray tube for color display in accordance with claim 2, which further comprises a photoabsorptive material layer (2) formed in a matrix manner and disposed between said separate fluorescent material layer (4) and the inner surface of said face plate (1).

5. A cathode ray tube for color display, comprising:

a face plate, said face plate having an inner surface, a picture element layer formed on the inner surface of said face plate and including three distinct types of luminescent picture elements, and a fluorescent material layer formed on the inner surface of said face plate together with said picture element layer, said fluorescent material layer having a ten percent afterglow time less than 50 microseconds.

6. A cathode ray tube for color display, comprising:

a face plate, said face plate having an inner surface, a picture element layer formed on the inner surface of said face plate and including three distinct types of luminescent picture elements, at least one of said picture elements having a short persistence time, and a fluorescent material layer formed on the inner surface of said face plate together with said picture element layer and having a persistence time for ten percent afterglow less than 50 microseconds.

7. In a cathode ray tube for color display having a face plate, said face plate having an inner surface, a picture element layer formed on the inner surface of said face plate and including a plurality of distinct types of luminescent picture elements, at least one of said picture elements having a short persistence time, the improvement comprising a separate fluorescent material layer for interaction with a light pen formed on the inner surface of said face plate together with said picture element layer and having a persistence time for ten percent afterglow less then 50 microseconds.

* * * * *